United States Patent [19]

Zechner

[11] Patent Number: 4,900,002

[45] Date of Patent: Feb. 13, 1990

[54] SHEET FOLDING APPARATUS

[76] Inventor: Karl Zechner, Wiener Strasse 25, A-8630 Mariazell, Austria

[21] Appl. No.: 285,770

[22] Filed: Dec. 16, 1988

[30] Foreign Application Priority Data

Dec. 22, 1987 [AT] Austria ..... 3399/87

[51] Int. Cl.[4] ..... B42C 1/00

[52] U.S. Cl. ..... 270/45; 270/32; 493/405

[58] Field of Search ..... 270/20.1, 32, 39, 40, 270/41, 45; 493/405, 417

[56] References Cited

U.S. PATENT DOCUMENTS 4,105,197 8/1978 Pott ..... 493/416

FOREIGN PATENT DOCUMENTS 63-134471 6/1988 Japan ..... 270/32

63-247269 10/1988 Japan ..... 270/32

*Primary Examiner*—Robert E. Garrett

*Assistant Examiner*—Therese M. Newholm

*Attorney, Agent, or Firm*—Kurt Kelman

[57] ABSTRACT

An apparatus for folding sheet material comprises a rotatable magazine comprising two folding plates having end edges extending parallel to each other for holding the sheet material with portions thereof projecting beyond the edges of the folding plates, and two folding rams wherebetween the rotatable magazine is mounted and which are displaceable with respect to each other, each folding ram having a substantially planar guide face facing the magazine and for guiding the projecting sheet material portions and cooperating with the end edges of the folding plates for bending the sheet material along the end edges upon rotation of the magazine. The magazine is rotatable 180° from a receiving position for the sheet material wherein the guide faces extend adjacent and substantially parallel to the folding plates, to a middle position wherein the guide faces extend substantially perpendicularly to the folding plates, and to a discharge position for the folded sheet material wherein a respective one of the projecting sheet material portions is bent about a respective one of the folding plate edges and the guide faces again extend adjacent and substantially parallel to the folding plates, the folding rams being in contact with the magazine in the receiving and discharge positions and rotation of the magazine causing the folding plates to be pressed apart.

12 Claims, 6 Drawing Sheets

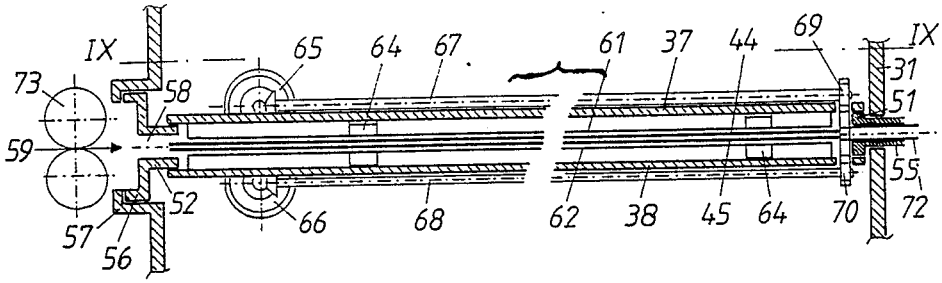
Fig. 8
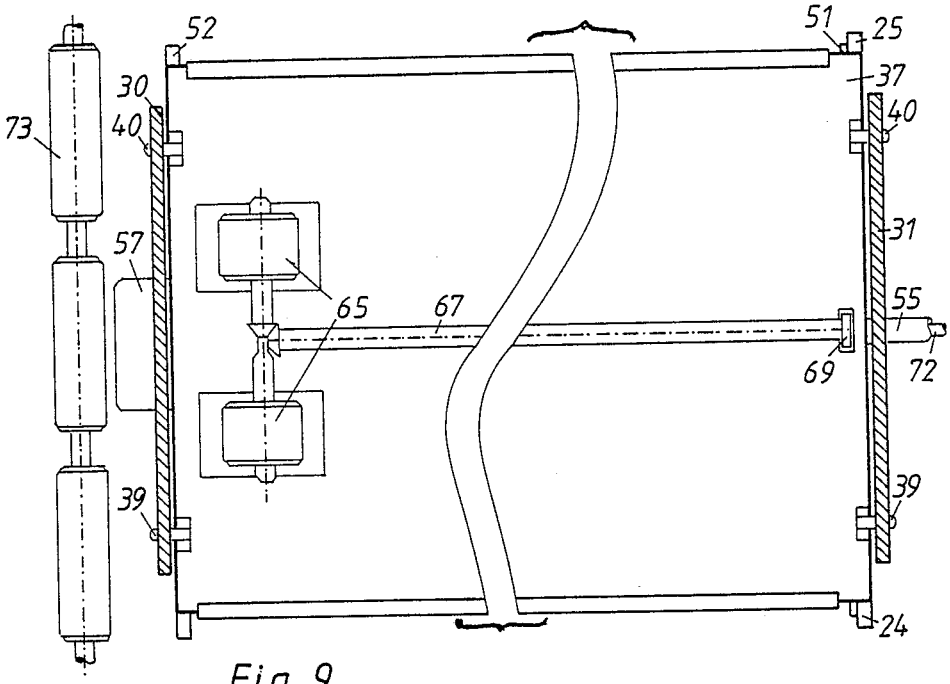
Fig. 9
Fig. 10
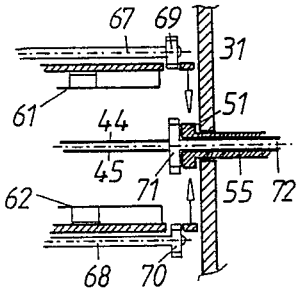

Fig. 11
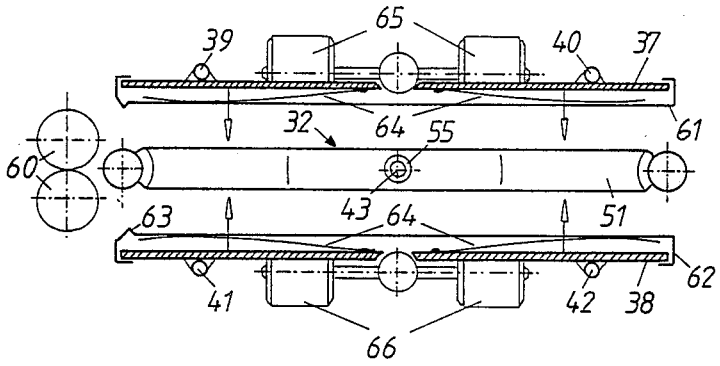
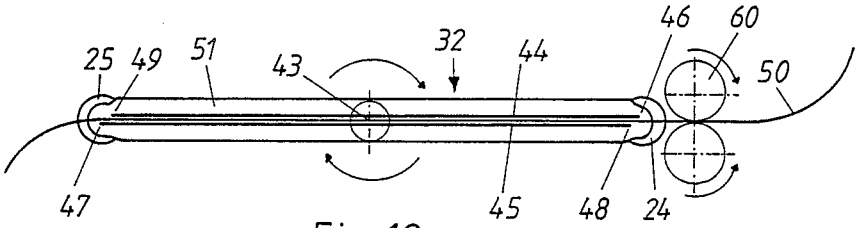
Fig. 12
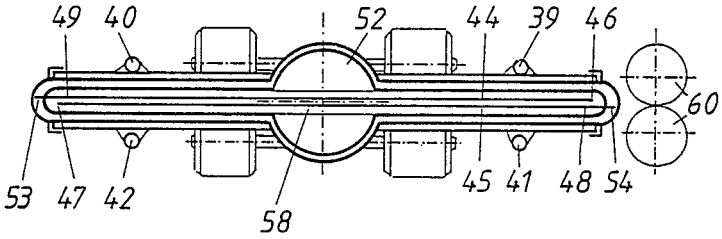
Fig. 13

Fig. 14
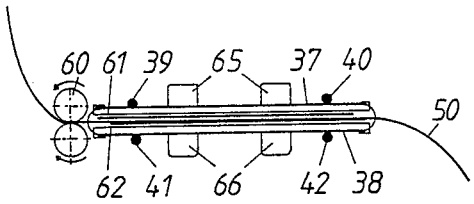
Fig. 15
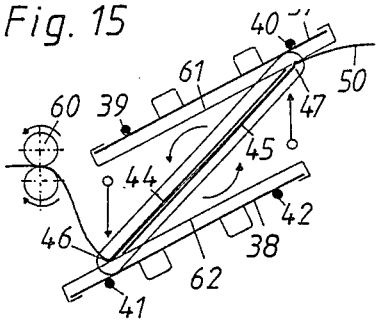
Fig. 16
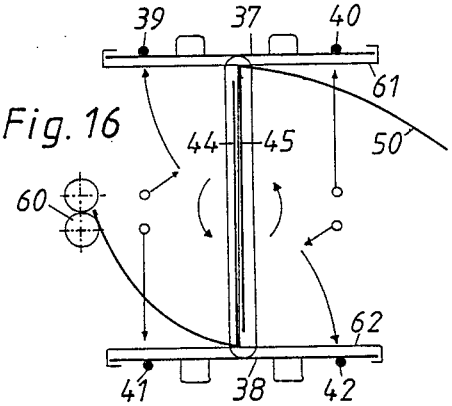
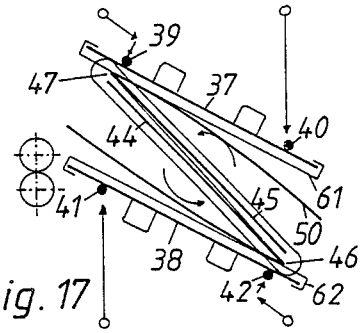
Fig. 17
Fig. 18
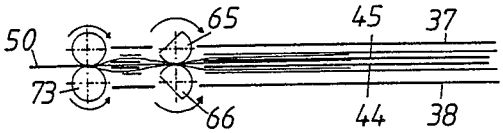
Fig. 19
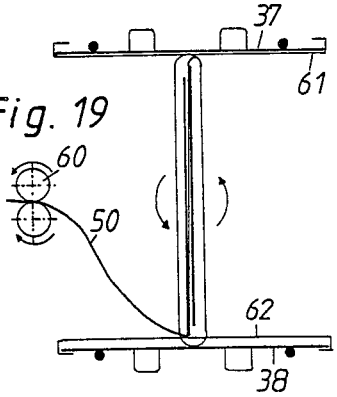
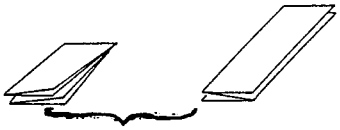
Fig. 20

SHEET FOLDING APPARATUS

BACKGROUND OF THE INVENTION (1) Field of the Invention

The present invention relates to an apparatus for folding sheet material, such as one or more paper sheets or the like, comprising a rotatable magazine holding the sheet material with portions thereof projecting beyond two parallel folding plates of the magazine, and folding elements arranged outside the magazine and bending the projecting sheet material portions about respective ones of parallel end edges of the folding plates upon rotation of the magazine.

(2) Description of the Prior Art

Such a folding apparatus has been used in a machine for folding mailing pieces in an envelope machine. Each mailing piece is first bent over a rear end edge of one of the folding plates before it is introduced with the resultant fold into the nip of a pair of pressure rolls which produce the desired pressed fold. In this known apparatus, the mailing piece is drawn between the folding plates by conveying rollers arranged in the magazine and passing through openings in the folding plates until they come to rest at the desired location of the mailing piece against the rear end edge of the folding plate. In this position, the mailing piece is engaged by the conveying rollers and the magazine is rotated not quite 180° until the mailing piece portion at the rear folding plate edge comes to rest against a pressure roller resiliently mounted outside of the magazine and, upon further rotation of the magazine into the 180° position, the pressure roller bends this mailing piece portion about the rear folding plate edge and presses the adjoining mailing piece portion against a guide roll affixed to the magazine. In this position, the folded mailing piece is transported forwardly out of the magazine and into the nip of the pair of pressure rolls by the conveying rollers, the pressure roller and the guide roll. The mailing piece leaves the machine after this single folding. For mailing pieces that must be folded several times, a series of such machines are arranged sequentially.

Other folding machines for providing zig-zag folds and various other types of folds for various paper sizes are also known. All known folding machines are designed for folding paper sheets of different sizes at a speed of 12,000 to 20,000 sheets/hour, with an automatic paper feed. The machines are technically quite complex, large and heavy. Particularly for the normal daily mailing pieces generated by small to medium-sized offices, up to 90% of which tend to be of a size DIN A 4 (about 8"×12"), these machines are too large.

SUMMARY OF THE INVENTION

It is a primary object of this invention to avoid these disadvantages in an apparatus for folding sheet material. The invention accomplishes this object with such an apparatus which comprises a rotatable magazine comprising two plates having end edges extending parallel to each other for holding the sheet material with portions thereof projecting beyond the end edges of the folding plates, and two folding rams wherebetween the rotatable magazine is mounted and which are displaceable with respect to each other, each folding ram having a substantially planar guide face facing the magazine and for guiding the projecting sheet material portions and cooperating with the end edges of the folding plates for bending the sheet material along the end edges upon rotation of the magazine. The magazine is rotatable 180° from a receiving position for the sheet material wherein the guide faces extend adjacent and substantially parallel to the folding plates, to a middle position wherein the guide faces extend substantially perpendicularly to the folding plates, and to a discharge position for the folded sheet material wherein a respective one of the projecting sheet material portions is bent about a respective one of the folding plate edges and the guide faces again extend adjacent and substantially parallel to the folding plates, the folding rams being in contact with the magazine in the receiving and discharge positions and rotation of the magazine causing the folding plates to be pressed apart.

The folding rams may be held in contact with the magazine by force of gravity and rotation of the magazine then causes the folding rams to be pressed apart against the force of gravity, or the folding apparatus may further comprise spring means biased to exert a force holding the folding rams in contact with the magazine, rotation of the magazine causing the folding rams to be pressed apart against the biasing force of the spring means.

Such a folding apparatus has the advantage of a simple construction, small dimensions and a low weight. A zig-zag fold can be obtained in contrast to the existing machines with a single 180° rotation of the magazine. For this purpose, the sheet material is fed in the receiving position of the magazine between the two folding plates until portions of the sheet material project to the same extent from the front and rear of the magazine. The magazine is thereupon rotated 180° and the zig-zag folded sheet material is discharged laterally from the magazine.

BRIEF DESCRIPTION OF THE DRAWING

The above and other objects, advantages and features of the present invention will become more apparent from the following detailed description of certain now preferred embodiments thereof, taken in conjunction with the generally schematic drawing wherein.

FIG. 8 is a cross section along line VIII—VIII of FIG. 7;

FIG. 9 is a cross section along line IX—IX of FIG. 8;

FIG. 10 is a fragmentary axial section showing the drive for rotating the magazine and the conveying rollers, with the contacting plates being lifted;

FIG. 11 is a side elevational view of the magazine, with the two contacting plates lifted off the drive spreading element;

FIG. 12 illustrates the inside of the drive spreading element, the two folding plates being shown in cross section;

FIG. 13 is a side elevational view of the discharge spreading element, with the contacting plates engaged;

FIGS. 14 to 18 illustrate the successive stages in forming a zig-zag fold;

FIG. 19 illustrate the production of a single fold as preparation for a cross fold;

FIG. 20 are perspective views showing a cross fold and a zig-zag fold, respectively;

DETAILED DESCRIPTION OF PREFERRED EMBODIMENTS

Figure 2:
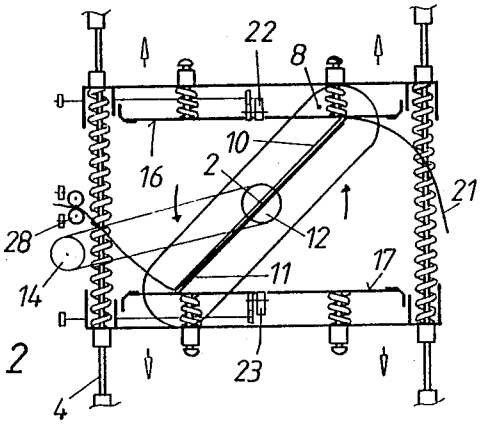
FIGS. 2 to 4 illustrate this apparatus in the sequential operating positions during the folding, with the housing removed.
Figure 4:
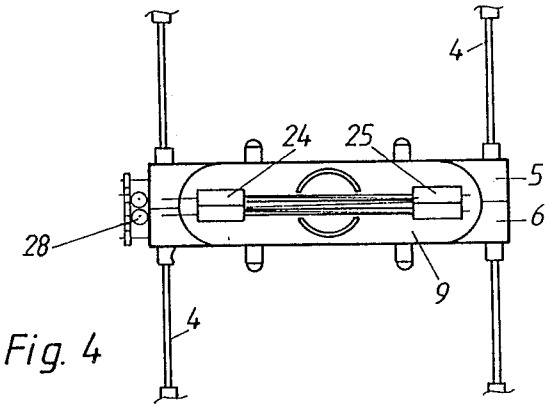

Referring now to the drawing and first to FIGS. 1 to 6, there is shown an apparatus for zig-zag folding sheet material, such as paper sheets of DIN A 4 size or the like. The apparatus comprises housing 1 and axle 2 affixed thereto, magazine 3 being rotatably mounted on fixed axle 2 between two parallel folding rams 5, 6 which are held in housing 1 on guide rods 4 for reciprocable displacement. Tension coil springs 7 on the guide rods connect the two folding rams and bias them towards each other and against magazine 3 held therebetween. The use of tension springs permits the biasing force to be adjusted to determine thereby the rotary force imparted to the magazine.

Magazine 3 comprises two lateral walls 8, 9 extending perpendicularly to axle 2 about which the magazine may be rotated and these walls engage folding rams 5, 6 so that rotation of the magazine causes the folding rams to be spread apart against the biasing force of spring means 7. These lateral walls thus constitute spreading elements, and this structural feature is particularly useful when sensitive sheet material is to be folded because most of the force required for spreading the folding rams apart is absorbed by the spreading elements. The magazine further comprises two thin folding plates 10, 11 connecting lateral walls 8, 9. The folding plates are spaced a very small distance from each other, for example about 2 mm, and extend parallel to each other on each side of axle 2 and symmetrically with respect thereto. The two thin folding plates are affixed over their entire length to the one lateral wall 8. The other lateral wall 9 defines discharge slot 15 and folding plates 10, 11 are attached to this lateral wall only over a portion of their length projecting beyond the discharge slot in the direction of its extension. Each folding plate 10, 11 has two end edges extending parallel to axle 2, which constitutes the rotary axis of magazine 3, and the spacing between the end edges, i.e. the width of the folding plates, corresponds to about a third of the length of the sheet material being folded while the length of the folding plates, which extends parallel to the rotary axis, is greater than the width of the sheet material. The length of discharge slot 15 is a little greater than a third of the length of the sheet material.

The outside of lateral magazine wall 8 carries driving pulley 12 connected by drive belt 14 to motor 13 for rotation of the magazine. The inside surfaces of folding rams 5, 6 facing magazine 3 have substantially planar guide faces 16, 17 arranged to cooperate with folding plates 10, 11 upon rotation of the magazine. In the illustrated embodiment, contacting plates 19, 20 are elastically supported on the inside folding ram surfaces by compression springs 18 and define guide faces 16, 17. This arrangement enables the sheet to be clamped to the end edges of the folding plates, the clamping pressure being adjustable by the yielding support of the contacting plates on the inside surfaces of the folding rams.

Figure 1:
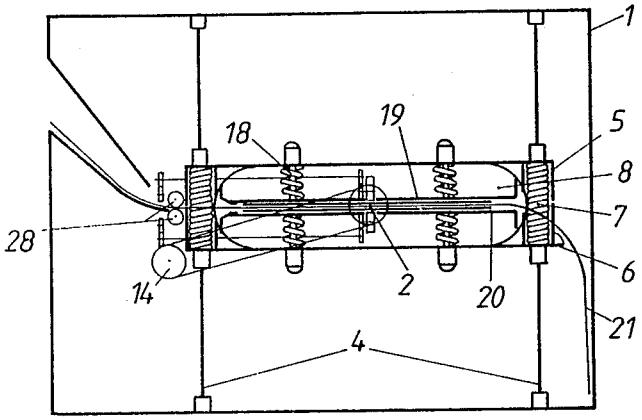
FIG. 1 shows an end view of a first embodiment of a folding apparatus of this invention, with the magazine in the receiving position and the housing shown in cross section.
Figure 3:
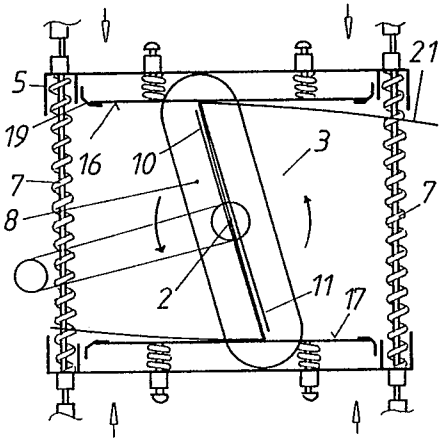

If it is desired to impart a zig-zag fold to a sheet 21 (see FIG. 20), i.e. to fold it into three equal parts as a letterhead, for example, is folded before being put into an envelope, the sheet is fed between folding plates 10, 11 of magazine 3 in the starting or receiving position thereof, shown in FIG. 1, so that the central third of sheet 21 rests between the folding plates in the magazine while respective thirds of the sheet project beyond the parallel end edges of the folding plates. Motor 13 is then switched on to rotate magazine 3 counterclockwise about rotary axis 2. During the first 90° of rotation (FIG. 2), the two lateral walls 8, 9 of magazine 3 spread folding rams 5, 6 apart against the bias of coil springs 7. At the same time, this rotation causes the sheet at the leading end edge of upper folding plate 10 to be pressed against guide face 17 of contacting plate 20 and at the trailing end edge of lower folding plate 11 to be pressed against guide face 16 of contacting plate 19 of upper folding ram 5, sheet 21 being folded about the end edges as magazine 3 continues to rotate counterclockwise (see arrows in FIGS. 2 and 3) while the leading third of the sheet projecting from magazine 3 in the feeding direction and the trailing third of the sheet projecting from the magazine opposite to the feeding direction are drawn into the magazine.

After the middle position of the rotating magazine, in which folding plates 10, 11 extend substantially perpendicularly to guide faces 16, 17 of folding rams 5, 6, has been passed (FIG. 3), the bias of coil springs 7 causes the folding rams to be pressed towards each other and thus to speed up the further rotation of magazine 3 into the discharge position since the folding rams press against the magazine. During the second quarter rotation of magazine 3, the leading one third portion of the sheet is pressed by guide face 16 of contacting plate 19 of upper folding ram 5 against the outside of lower folding plate 11 and, similarly, the trailing one third sheet portion is pressed by guide face 17 of contacting plate 20 of lower folding ram 6 against the outside of upper folding plate 10. In the discharge position (FIG. 4), guide faces 16, 17 again extend adjacent and substantially parallel to folding plates 10, 11, folding plate 10 now becomes the lower folding plate and folding plate 11 becomes the upper folding plate. In this discharge position, zig-zag folded sheet 21 is gripped by conveying rollers 22, 23, which are mounted in folding rams 5, 6 and have a flattened circumferential portion, and transported in the direction of rotary axis 2 to laterally arranged pairs 24, 25 of pressure rolls. Contacting plates 19, 20 and folding plates 10, 11 define registering openings 26, 27 (see FIG. 5) accommodating conveying rollers 22, 23 and the cylindrical circumferential portion of the conveying rollers passes through these openings and grips the folded sheet when these rollers are rotated out of the position wherein their flattened circumferential portion is turned inwardly to be flush with the folding plate. The conveying rollers whose rotary axes extend perpendicularly to the rotary axis of the magazine rapidly move the folded sheet out of the magazine in the direction of the magazine axis. The pressure rolls rotate about axes extending parallel to folding plates 10, 11 in the discharge position and perpendicularly to rotary axis 2 of magazine 3, a respective pair of pressure rolls being provided for each fold at a respective side of the magazine to press the folded sheet portions together.

Figure 6:
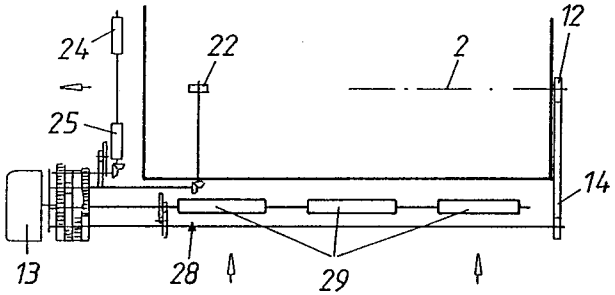
FIG. 6 shows the sheet material feeding and discharge mechanism of this apparatus.

A pair 28 of feeding rolls is mounted in housing 1 ahead of magazine 3 in the plane of its rotary axis 2 to feed the sheet material into the magazine, each feeding roll, as shown in FIG. 6, consisting of three coaxial rollers 29.

Figure 7:
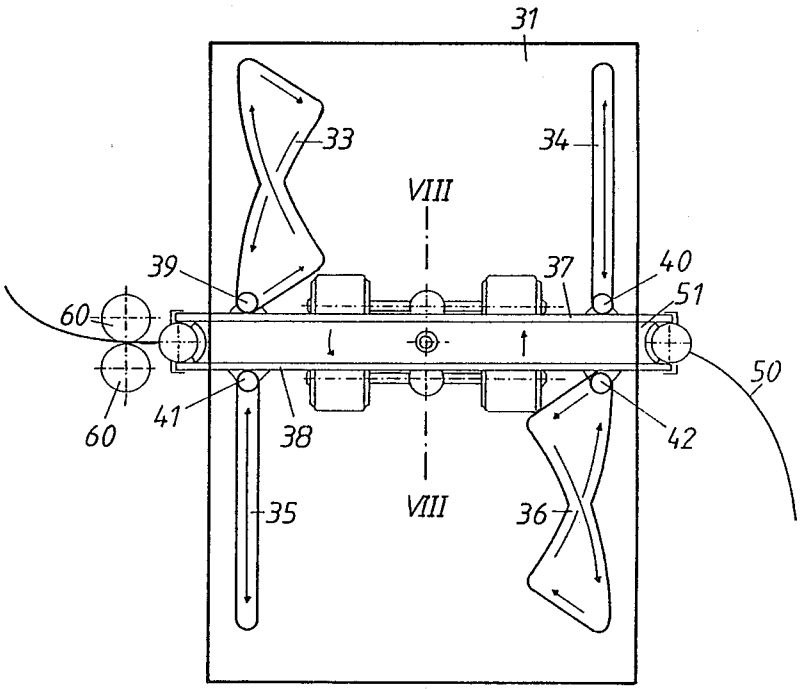
FIG. 7 is a side elevational view of another embodiment of the folding apparatus.
Figure 5:
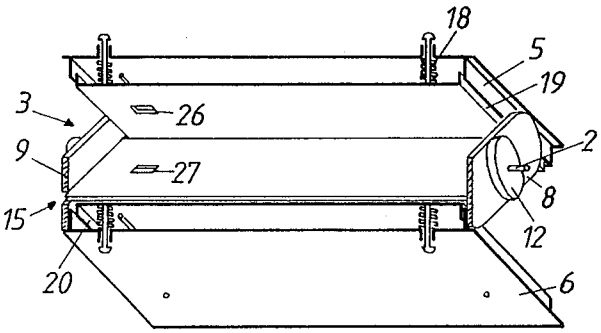
FIG. 5 is a perspective view of this apparatus, with the magazine turned 45°.

In the embodiments of the folding apparatus illustrated in FIGS. 7 to 19, the housing for the apparatus has not been shown. The apparatus is held in this housing by two opposite arranged mounting plates 30, 31 which provide the bearing for magazine 32 and for cam or guide bearings 33 to 36 for guide pins 39 to 42 laterally mounted on folding rams 37, 38 (see FIGS. 7, 11 and 12).

Magazine 32 comprises two thin folding plates 44, 45 spaced parallel to each other at a distance of about 2 mm and symmetrically arranged at each side of rotary axis 43 of the magazine and parallel thereto. Lower folding plate 45 is rearwardly staggered from upper folding plate 44 transversely to rotary axis 43 so that leading folding end edge 46 of upper folding plate 44 and trailing folding end edge 47 of lower folding plate 45 are arranged at a greater distance from rotary axis 43 than corresponding leading end edge 48 of lower folding plate 45 and trailing end edge 49 of upper folding plate 44, respectively, as can be seen in FIG. 12. The distance of leading end edge 46 of upper folding plate 44 from trailing end edge 47 of lower folding plate 45 corresponds to one third of the length of sheet 50 to be folded. The magazine further comprises two lateral elements 51, 52 extending at respective sides of the folding plates perpendicularly to rotary axis 43 and engaging the folding rams for spreading the same upon rotation of magazine 32. Driving magazine element 51 has a hollow shaft 55 rotatably mounted on mounting plate 31, and magazine element 52 at the discharge side has a cylindrical inner gear 56 affixed thereto, which meshes with a concentrically surrounding outer gear 57 mounted on mounting plate 30. The discharge magazine element defines a discharge slot 58 extending parallel to the side edges of folding plates 44, 45 and registering in the receiving and discharge positions of magazine 32 with a lateral discharge slot 59 in mounting plate 30 and its annular gear 57. Driving magazine element 51 is rigidly affixed to both folding plates 44, 45 along their entire length while discharge magazine element 52 is attached to upper folding plate 44 only by means of upper folding plate extension 53 projecting from its trailing end edge 49 beyond trailing end edge 47 of lower folding plate 45, and to lower folding plate 45 only by means of lower folding plate extension 54 projecting from its leading end edge 46 beyond leading end edge 46 of upper folding plate 44 (FIG. 13).

Upon driving hollow shaft 55, magazine 32 is rotated counterclockwise 180° about axis 43, causing magazine elements 51, 52 to press folding rams 37, 38 apart during the first 90° turn. This causes the folding rams to be tilted out of their starting position according to the camming configuration (see FIG. 7) of guide bearings 33-36 in mounting plates 30, 31 for guide pins 39-42. Four tension springs (not shown), which may be affixed to guide pins 39-42 outside mounting plates 30, 31, bias folding rams 37, 38 against magazine 32, that is against its lateral elements 51, 52. Upon further rotation of the magazine from the middle position to the discharge position, the spring force causes the two folding rams to be displaced towards each other again, as has been described hereinabove in connection with the embodiment of FIGS. 1 to 6.

Folding begins with the feeding of a sheet 50 into magazine 32 in the receiving position thereof. For this purpose, the sheet is fed by a pair 60 of cooperating feeding rolls between folding plates 44, 45 until its center third is held therebetween while a respective third projects from the magazine at the leading and trailing ends thereof. The pair of feeding rolls has a slip coupling so that sheet 50 is freely pulled out of the nip of the rolls when magazine 32 is rotated. Since leading end edge 48 of lower folding plate 45 adjacent the pair of feeding rolls is rearwardly staggered from leading end edge 46 of upper folding plate 44, sheet 50 is clamped immediately upon the start of rotation of magazine 32 between leaning end edge 46 of upper folding plate 44 and an oppositely arranged nose 63 projecting from contacting plate 62. This clamping force prevents twisting of the sheet during folding. Since the rotating force is transmitted by driving magazine element 51 to opposite magazine element 52 by folding plates 44, 45 attached to these magazine elements, sheet 50 is additionally clamped between the folding plates because of a slight twisting of the folding plates with respect to each other.

As in the previously described embodiment and shown, for example, in FIG. 8, folding rams 37, 38 have contacting plates 61, 62 on their inside surfaces and these contacting plates are supported yieldingly thereon by compression springs 64. Therefore, when rotation of magazine 32 causes lateral magazine elements 51, 52 to spread the folding rams apart, yieldingly mounted contacting plates 61, 62 will be slightly pressed by folding plates 44, 45 against folding rams 37, 38, compression springs 64 exerting a counter-bias against the contacting plates when they are depressed. Rubbing of the two ends of driving magazine element 51 against the contacting plates during the spreading apart of the folding rams is avoided by anti-friction rollers 51', 51" mounted on the driving magazine element ends. The motion of folding rams 37, 38 during their moving-apart displacement is controlled by the camming configuration of guide bearings 33-36, as will now be described:

At the beginning of rotation of magazine 32, folding rams 37, 38 are spread apart only at guide pins 40 and 41 because of the spring bias on guide pins 39-42 (not shown), and these guide pins are linearly displaced outwardly along straight guide bearings 34, 35. As the magazine continues to rotate, guide pins 39 and 42 are displaced obliquely inwardly in guide bearings 33 and 36 (see FIG. 7) and are then pressed outwardly until the middle position (90° turn) has been reached, going through a motion shown in FIGS. 7, 15 and 16. As shown in FIGS. 15–17, this tilting motion of folding rams 37, 38 causes sheet 50 to be bent over end edges 46 and 47 of folding plates 44 and 45. As the rotation continues from 90° to 180°, i.e. from the middle position back into the receiving position, the spring bias will allow guide pins 40, 41 to return to their starting position and the two folding rams to be pressed together.

Two pairs 65, 66 of conveying rollers are mounted on the outside of folding rams 37, 38 for pulling the folded sheet from folding plates 44, 45. The circumferences of the conveying rollers are so flattened on the sides of the folding rams facing contacting plates 61, 62 that the conveying rollers will not hinder the displacement of the contacting plates when their flattened circumferential portions face inwardly. The rotation of the conveying rollers from this rest position is effected by planet pinions 69, 70 keyed to shafts 67, 68 and meshing with gear 71 when folding rams 37, 38 are engaged with lateral magazine elements 51, 52. Gear 71 is driven by shaft 72 which passes through hollow shaft 55 of driving magazine element 51. (See FIG. 10). An electromagnetically operated control may be used to prevent operation of the driving gears during this operation stage so that folding rams 37, 38 cannot be disengaged from magazine elements 51, 52. Generally, the folding speed is lower than in conventional folding apparatus, depending on the special requirements of individual folding operations.

To discharge the folded sheet, conveying rollers 65, 66 are rotated to pass through registering openings in folding rams 37, 38, contacting plates 61, 62 and folding plates 44, 45 to grip sheet 50, push it through discharge slot 58 in lateral magazine element 52 at the discharge side of magazine 32 and to deliver it through discharge slot 59 in mounting plate 30 to pressure rolls 73. The rotary speed of conveying rollers 65, 66 and pressure rolls 73 are synchronized. The sheet folded during the 180° rotation of magazine 32 is pressed by rolls 73 and discharged. An optical eye (not shown) is arranged immediately in front of feeding rollers 60 to start the three sequential operating stages of (1) feeding the sheet into the magazine, (2) rotating the magazine and (3) driving the conveying rollers and pressure rolls when a sheet is fed to the apparatus. This prevents feeding a subsequent sheet to the apparatus during the folding stages performed on a preceding sheet.

If it were desired to produce a cross fold, it is only necessary to select a greater displacement stroke for contacting plate 61 yieldingly supported on upper folding ram 37 and to mount an electromagnet (not shown) on the outside of folding ram 37 to attract contacting plate 61 into its upper end position. In this case, the sheet is first fed to the center of magazine 32 widthwise. To avoid bending the short portion of the sheet projecting beyond folding plates 44, 45, the electromagnet attracts the contacting plate closer to the folding ram (FIG. 19). The sheet is then folded in the above-indicated manner and after the lengthwise folded sheet is discharged, it is turned 90° and folded again.

Figure 21:
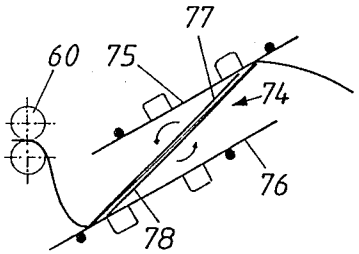
FIG. 21 is a highly diagrammatic cross section of a third embodiment of a folding apparatus.

In the illustrated embodiments, the guide faces cooperating with the folding plates in producing the folds are shown to be defined by the inside surfaces of contacting plates yieldingly supported on the inside of the folding rams. However, these guide faces could also be defined directly by the inside surfaces of the folding rams, in which case, as shown in FIG. 21, magazine 74 is so constructed that the insides of folding rams 75, 76 are in direct contact with the outsides of folding plates 77, 78 in the receiving position of the magazine, and the folding rams are pressed apart by the folding plates, and not by lateral magazine walls acting as spreading elements, upon rotation of the magazine in a counterclockwise direction.

Figure 23:
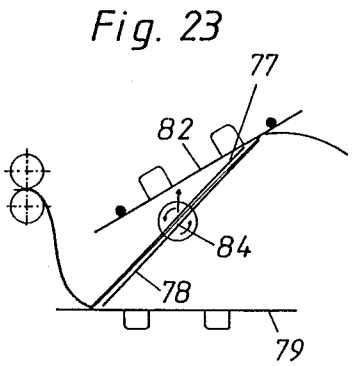
FIG. 23 is a highly diagrammatic cross section of a modification of the embodiment of FIG. 22, with a stationary lower folding plate.
Figure 22:
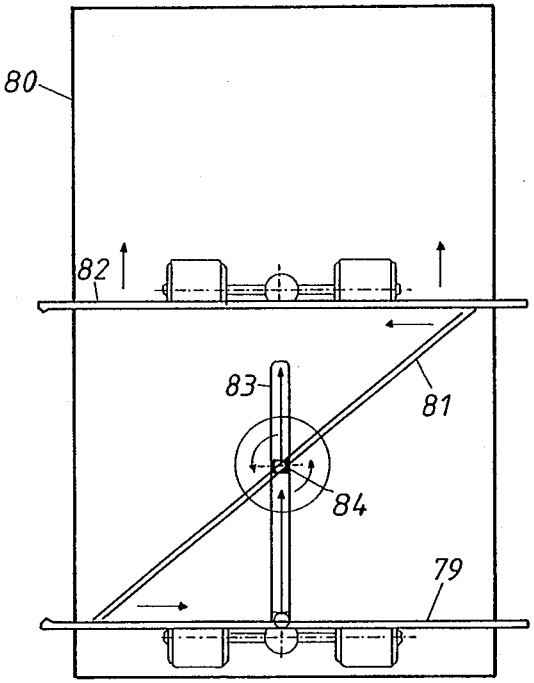
FIG. 22 is a highly diagrammatic cross section of a fourth embodiment of a folding apparatus, with a stationary folding plate.

In the embodiments illustrated in FIGS. 22 and 23, lower folding ram 79 of the folding apparatus is fixedly mounted in housing 80 and upper folding ram 82 as well as magazine 81 are vertically displaceable for reciprocation in guides provided in the housing. These embodiments use only the force of gravity and no spring connections between the folding rams are required. In the receiving position, the force of gravity causes magazine 81 to rest on lower folding ram 79 and upper folding ram 82 to rest on the magazine. In these embodiments, the rotary axis for the magazine is not fixedly mounted in the housing but axle 84 supporting the magazine for rotation is vertically displaceably guided in vertical guide track 83. When magazine 81 is rotated, it remains in engagement with stationary lower folding ram 79 and presses upper folding ram 82 upwards against the force of gravity while axle 84 moves up in guide track 83. After the middle position has been reached upon 90° rotation of magazine 81, the weight of upper folding ram 82 increases the rotary power so that the magazine will continue its rotation under its own weight while axle 84 glides down in guide track 83. In these embodiments, no springs are needed to pull the folding rams together as the magazine rotates from its middle to the discharge position, the force of gravity exerted by the weights of the upper folding ram and the rotating magazine being sufficient for this purpose. The upper folding ram 82 may be vertically linearly guided in housing 80 (FIG. 22) or it could be guided in a manner similar to that shown and described in connection with FIG. 7 so that the folding proceeds in a tilting movement (FIG. 23).

What is claimed is:

1. An apparatus for folding sheet material, which comprises (a) a rotatable magazine comprising (1) two folding plates having end edges extending parallel to each other for holding the sheet material with portions thereof projecting beyond the end edges of the folding plates, and (b) two folding rams wherebetween the rotatable magazine is mounted and which are displaceable with respect to each other, each folding ram having a substantially planar guide face facing the magazine and for guiding the projecting sheet material portions and cooperating with the end edges of the folding plates for bending the sheet material along the end edges upon rotation of the magazine, (1) the magazine being rotatable 180° from a receiving position for the sheet material wherein the guide faces extend adjacent and substantially parallel to the folding plates, to a middle position wherein the guide faces extend substantially perpendicularly to the folding plates, and to a discharge position for the folded sheet material wherein a respective one of the projecting sheet material portions is bent about a respective one of the folding plate edges and the guide faces again extend adjacent and substantially parallel to the folding plates, the folding rams being in contact with the magazine in the receiving and discharge positions and rotation of the magazine causing the folding plates to be pressed apart.

2. The folding apparatus of claim 1, wherein the folding rams are held in contact with the magazine by force of gravity and rotation of the magazine causes the folding rams to be pressed apart against the force of gravity.

3. The folding apparatus of claim 1, further comprising spring means biased to exert a force holding the folding rams in contact with the magazine, rotation of the magazine causing the folding rams to be pressed apart against the biasing force of the spring means.

4. The folding apparatus of claim 1, further comprising a housing wherein one of the folding rams is stationarily mounted and the magazine and the other folding ram are displaceably guided with respect to the stationary folding ram.

5. The folding apparatus of claim 1, further comprising a housing, an axle affixed to the housing, the magazine being rotatably mounted on the fixed axle and the two folding ram being displaceably guided in the housing.

6. The folding apparatus of claim 1, wherein the magazine comprises a spreading element mounted at least on one side of the magazine between the folding rams for engaging and spreading the folding rams apart.

7. The folding apparatus of claim 6, wherein lateral walls at an inlet and a discharge side of the magazine constitute the spreading elements and the spreading element at the discharge side defines a discharge slot for the folded sheet material.

8. The folding apparatus of claim 1, further comprising contacting plates defining the guide faces, the contacting plates being yieldingly supported on the inside surfaces of the folding rams.

9. The folding apparatus of claim 1, further comprising at least one projection extending from each guide face and facing the magazine for clamping the projecting sheet material portion to a respective one of the end edges.

10. The folding apparatus of claim 9, wherein the projection is a rib extending parallel to the respective end edge.

11. The folding apparatus of claim 1, wherein the folding rams carry conveying rollers arranged to engage the projecting sheet material portions and extending transversely to an axis of rotation of the magazine.

12. The folding apparatus of claim 1, further comprising pressing rolls for the folded sheet material, the pressing rolls being arranged laterally adjacent the magazine and extending perpendicularly to an axis of rotation of the magazine and parallel to the folding plates in the discharge position.

* * * * *